US005765252A

United States Patent [19]

Carr

[11] Patent Number: 5,765,252

[45] Date of Patent: Jun. 16, 1998

[54] FINGER OR HAND MOUNTED BRUSH

[76] Inventor: Clairice M. Carr, 15 S. Jordan, Miles City, Mont. 59305

[21] Appl. No.: 682,008

[22] Filed: Jul. 16, 1996

[51] Int. Cl.[6] ..... A46B 5/04

[52] U.S. Cl. ..... 15/104.94; 15/167.1; 15/227; D4/103

[58] Field of Search ..... D4/103; 15/104.94, 15/110, 167.1, 227

[56] References Cited

U.S. PATENT DOCUMENTS

| | | | |
|---|---|---|---|
| D. 290,426 | 6/1987 | Courney | 15/227 |
| D. 363,606 | 10/1995 | Abrahamson | D4/103 |
| 1,200,596 | 10/1916 | Daly . | |
| 1,343,713 | 6/1920 | Fuller . | |
| 1,894,413 | 1/1933 | Nenning et al. . | |
| 2,092,987 | 9/1937 | Remington . | |
| 2,419,896 | 4/1947 | Hobelmann . | |
| 2,439,056 | 4/1948 | Rathbun . | |
| 2,756,448 | 7/1956 | Werbe | 15/227 |
| 3,043,295 | 7/1962 | Ward | 15/110 |
| 3,298,507 | 1/1967 | Micciche . | |
| 3,675,264 | 7/1972 | Storandt . | |
| 3,902,509 | 9/1975 | Tundermann et al. . | |
| 4,134,172 | 1/1979 | Arce . | |
| 4,292,705 | 10/1981 | Stouffer . | |
| 4,308,860 | 1/1982 | Sanders et al. | 15/227 |
| 4,628,949 | 12/1986 | Mas et al. | 15/227 |
| 4,679,274 | 7/1987 | Friedman . | |
| 5,068,941 | 12/1991 | Dunn . | |
| 5,107,562 | 4/1992 | Dunn . | |
| 5,213,428 | 5/1993 | Salman . | |
| 5,327,688 | 7/1994 | Norkus . | |
| 5,348,153 | 9/1994 | Cole . | |
| 5,356,005 | 10/1994 | Burrello . | |

*Primary Examiner*—David Scherbel
*Assistant Examiner*—Terrence R. Till
*Attorney, Agent, or Firm*—Jacobson, Price, Holman & Stern, PLLC

[57] ABSTRACT

A finger brush device including bristles of a configuration which taper towards a pointed apex or are of a traditional toothbrush bristle configuration. In addition, the brush device may include a plurality of bumps which would act as a massaging device. Alternatively, a combination of bristles and bumps can form the exterior surface of the brush device. For use with children, the brush device includes an animated face or animal drawing which would be found attractive to children. In addition, an anchor ring is used to secure the finger mounted brush to an adjacent finger of a child to secure the brush on two fingers and prevent accidental removal. The brush device may be in the form of a five fingered glove.

3 Claims, 2 Drawing Sheets

FIG. 1
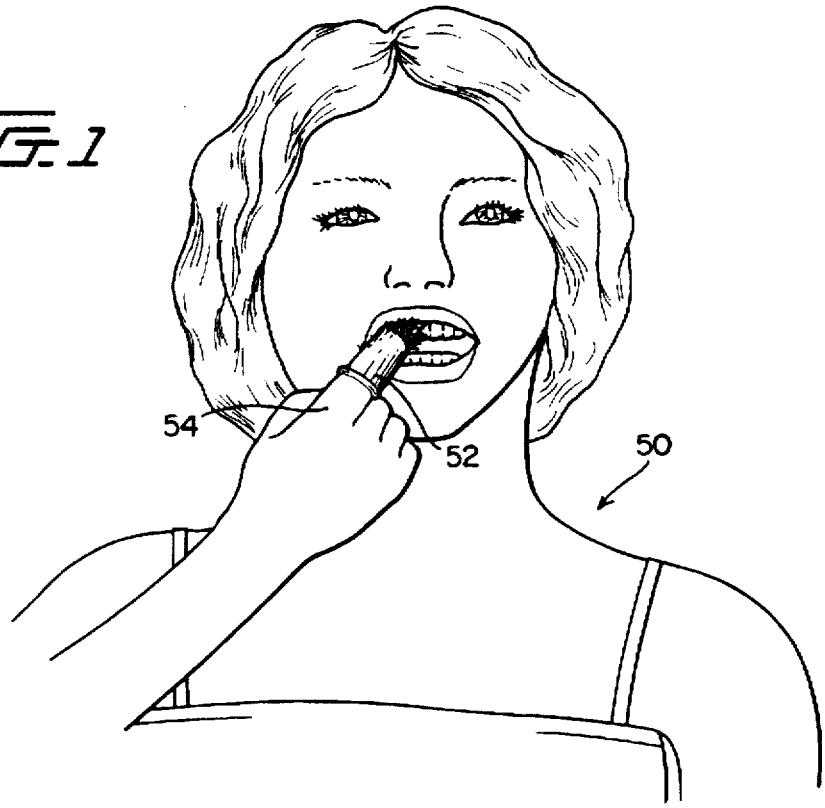
FIG. 2
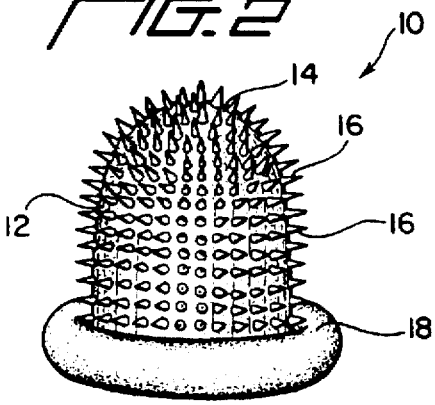
FIG. 3
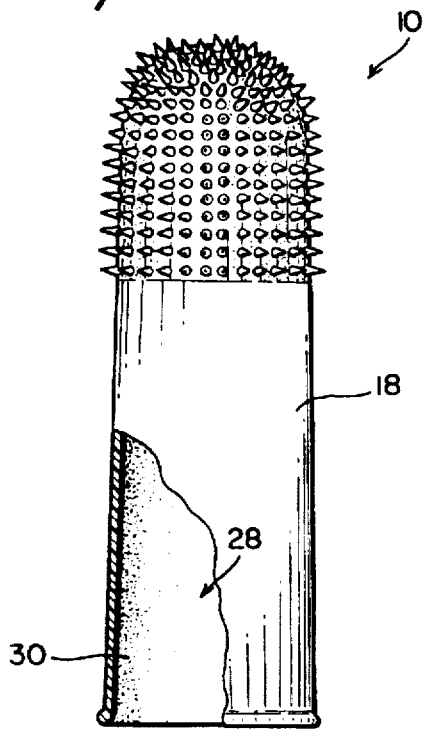
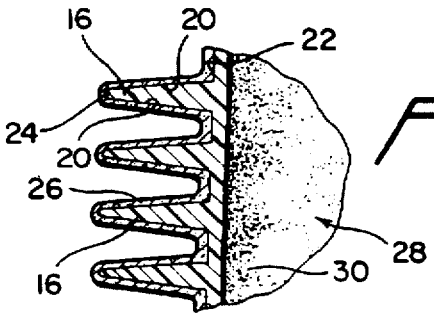
FIG. 4

FINGER OR HAND MOUNTED BRUSH

FIELD OF THE INVENTION

The present invention relates to a brush which can be mounted on a finger or a hand of an individual and can be used for brushing of teeth, massaging of gums, removing or applying cosmetics, cleaning jewelry, veterinary uses, and medical uses, for example.

Background of the Invention

Past developments in finger mounted brushes have varied greatly in design. Teeth cleaning applicators which are finger manipulated are well known, and there are numerous patents disclosing devices designed for brushing and cleaning of teeth. For example, some of these devices have been developed for placement on and surrounding at least a finger portion. When it is desired to brush the teeth of an individual, the device is mounted onto the finger, and in some instances contacted with water, to activate a dehydrated tooth cleanser. The dried tooth cleaning composition, when wet, forms a layer of a toothpaste-like substance. The tooth cleanser is then applied to the teeth of an individual. These devices are mounted onto and extend from a tip portion of a finger with the remainder of the finger portion being a base from which the tooth cleaning applicator extends. Other devices use the finger as a guide for an attachment which takes the form of an elongated brush head or brush pad. For example, the following U.S. patents disclose finger mounted teeth cleaning devices which surround a finger and particularly the tip of the finger: U.S. Pat. Nos. 1,200,596, 1,343,713, 2,419,896, 2,092,987, 1,894,493, 3,298,507, 3,675,264, 3,902,509, 4,292,705, 5,068,941, 5,107,562, 5,213,428, 5,348,153 and 5,356,005.

Other finger mounted devices are also known. For example in U.S. Pat. Nos. 2,439,056, 4,134,172 and 4,679,274, an applicator is attached to a finger so that only a portion of the finger is used as a tooth cleaning applicator.

In addition, U.S. Pat. No. 5,327,688 discloses an embracing jacket for a human digit which is worn on the thumb or finger for embracing a work piece and enhancing the ability of the thumb or finger to grip the workpiece. The jacket includes abrasive elements formed by a layer of abrasive material which may include an underlying substrate layer stiffer than the deformable abrasive region.

Thus, the prior finger mounted devices require a device particularly suited for a single function. As such, these prior teeth cleaning or abrasive applicators, are limited in their use and are not suitable for multiple functions or for use by both adults and children.

Further, the prior art devices are not particularly appealing to children. No special precautions have been taken to adapt the prior devices for use by children and to avoid the inherent dangers in having children putting small objects in their mouths, for example.

SUMMARY OF THE INVENTION

In contrast to the prior art devices, the finger or hand mounted brush of the present invention is capable of multiple uses. The securing of the brush device of the present invention on the finger of an individual is facilitated by an interior surface having a non-slip lining or surface character such that the device is maintained on a fingertip and along the length of a finger as a sheath portion is unrolled along the finger into a position of use, in the finger mounted version of the invention. The brush device of the present invention may include bristles of a configuration which taper inwardly towards a pointed apex or be of a traditional toothbrush bristle configuration. In addition, the brush device may include a plurality of bumps which act as a massaging device. Alternatively, a combination of bristles and bumps can be formed on the exterior surface of the brush device.

For use with children, the brush device includes an animated face or animal drawing which would be found attractive to children. In addition, an anchor ring is used to secure the finger mounted brush of the present invention to an adjacent finger of a child to secure the brush on two fingers of a child and prevent accidental removal and possible choking of the child. In addition, for use with children, the brush device may be in the form of a five fingered glove to prevent the possibility of swallowing by children.

In all embodiments, the bristles or bumps or combination thereof located on the exterior surface of the brush device may include a layer of dehydrated toothpaste or mouthwash which when contacted with water, in the case of toothpaste, would rehydrate and produce a suitable paste-like composition to form an abrasive layer for teeth brushing.

The brush device incorporating the principles of the present invention is made of a flexible, elastic material which, in the finger mounted embodiment, is rollable up onto itself to occupy only a very small portion of its extended length. When rolled onto a finger, the brush device is slightly stretched so as to firmly grip a finger. In addition, the brush is lined, at least in a sheath portion, with a non-slip coating or lining to further ensure secure engagement with the finger.

In accordance with the present invention, the finger or hand mounted brush device can be of different sizes, lengths, colors and include different designs. The bristles of the brush may optionally be coated with dehydrated toothpaste or mouthwash for oral hygiene use. It may also be packaged singly, or in any suitable multiples.

In addition, the bristles of the brush can be used for removing or applying cosmetics or as a facial or body cleaning aid. The bristles are also useful for cleaning dentures, jewelry or household items. In medical applications, the finger or hand mounted brush device of the present invention can be used for cleaning burns, scraps or wounds in a hospital or in the field. For medical and oral hygiene applications, the brush is also sterilized and may be disposable after a single use.

In the embodiment of the hand mountable glove incorporating the principles of the present invention, the glove can be used by small children for oral hygiene purposes or, alternatively, used as a cleaning or polishing glove or for veterinary use to provide increased gripping during cleaning of the teeth of an animal.

Accordingly, it is an object of the present invention to provide a simple, easy to use and inexpensive cleaning brush for use by individuals to effectively clean and/or massage a surface.

It is another object of the present invention to provide a brush which is securable to a finger by an elongated sheath which is rollable onto the finger of an individual and includes a nonslip lining for securing the sheath to the finger.

It is a further object of the present invention to provide a finger brush having at least one of bristles and bumps to provide an abrasive surface on the exterior of the finger brush and including a non-slip lining on the interior of the finger brush.

It is a still further object of the present invention to provide a finger brush having at least one of bristles and bumps on the exterior surface of the brush and including dehydrated toothpaste coating the exterior surface of the brush.

It is still yet another object of the present invention to provide a finger brush including an animated face or drawing which is appealable to children and including a safety ring projecting from the base of the sheath of the finger brush for securing the brush to two fingers of a child.

It is yet another object of the present invention to provide a glove having a plurality of fingers in the configuration of the inventive finger brush.

A final object of this invention to be specifically enumerated herein is to provide a finger or hand mounted brush device in accordance with the preceding objects which will conform to conventional forms of manufacture, be of simple construction and easy to use so as to provide a brush device that would be economically feasible and relatively trouble free in operation.

These together with other objects and advantages which will becomes subsequently apparent reside in the details of construction and operation as more fully hereinafter described and claimed, reference being had to the accompanying drawings forming a part hereof, wherein like numerals are referred to like parts throughout.

BRIEF DESCRIPTION OF THE DRAWINGS

FIG. 1 is an environmental view of the new finger brush of the present invention mounted on a finger of an individual and being used for oral hygiene and massaging of the gums of the individual.

FIG. 2 is a front perspective view of the finger brush in a rolled-up form, embodying the principles of the present invention.

FIG. 3 is a partially cut-away side elevational view of the finger brush of the present invention in its unrolled or fully extended form exposing a finger sheath and a tip portion including a plurality of bristles.

FIG. 4 is a sectional view of a portion of the bristles at the tip of the finger brush of the present invention which illustrates the bristles having a dehydrated toothpaste coating on the exterior surface of the finger brush and a non-slip lining on the interior surface of the finger brush.

DETAILED DESCRIPTION OF THE PREFERRED EMBODIMENTS

Figure 5:
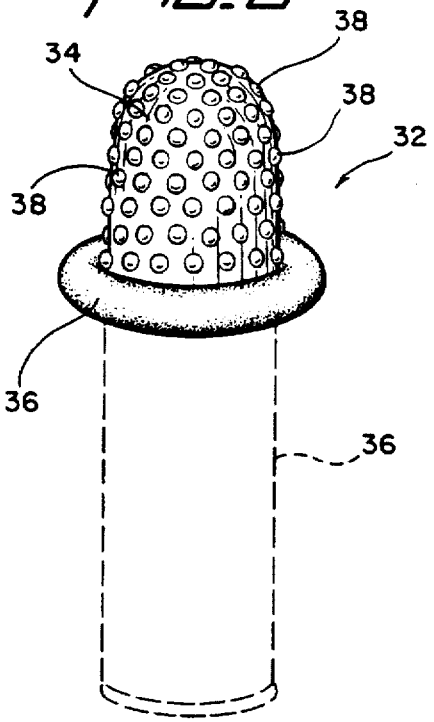
FIG. 5 is a front perspective view of an alternative embodiment of the exterior surface of the finger brush of the present invention including a plurality of bumps on a tip portion of the finger brush and illustrating in dotted lines the elongated sheath of the finger brush as would be seen when the sheath is unrolled onto a finger.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 2 and 3, in particular, the finger mounted brush device embodying the teachings of the present invention is generally designated as 10. The brush device 10 includes a tip portion 12 having a closed end 14 with a plurality of bristles 16 mounted on the exterior surface of the tip portion 12. Tip portion 12 is designed to fit onto the fingertip of an individual.

When the tip portion 12 is placed onto the fingertip of an individual, a sheath portion 18, shown in a rolled configuration in FIG. 2 and an unrolled configuration in FIG. 3, is unrolled onto the finger of the individual who will be using the finger mounted brush device.

The bristles 16 may take various forms dependent upon the desired use. In FIGS. 2–4, the bristles 16 include converging sidewalls 20 which extend from a base or exterior surface 22 of the tip portion towards an apex 24. The bristles may also take a configuration known to one of ordinary skill in the art such as a configuration used on any known toothbrush.

In FIG. 4, the bristles 16 are shown as including a coating formed of a layer 26 of dehydrated toothpaste. The toothpaste layer 26 is activated by contacting the layer 26 with water. Water is absorbed into the layer to rehydrate the layer and form a toothpaste composition. The finger mounted brush 10 may then be used as a toothbrush.

On an interior surface 28 of at least the sheath portion 18 of the brush 10 is located a roughened surface or lining 30. The surface 30 reduces the amount of sliding between at least the sheath portion 18 and the finger of the individual when using the finger mounted brush of the present invention. The roughened surface acts as a non-slip lining on the interior of the finger mounted brush.

In an alternative embodiment of the present invention, which incorporates the principles of the present invention, and as shown in FIG. 5, a finger mounted brush 32 includes a tip portion 34, and a sheath portion 36 shown in solid lines in a rolled-up configuration and shown in dotted lines in the extended, in use configuration. In FIG. 5, the tip portion 34 includes a plurality of bumps or dimples 38 of semi-spherical configuration. These bumps or dimples have a massaging affect when used in a dental or other application.

As, with reference to FIG. 4, the finger mounted brush 32 may also include a layer of dehydrated toothpaste or mouthwash, for example. Due to the reduced height of the bumps or dimples 38 as compared with the bristles 16 shown in FIGS. 2 through 4, the finger mounted brush 32 may be used where a gentler brushing or massaging effect is desired.

Figure 6:
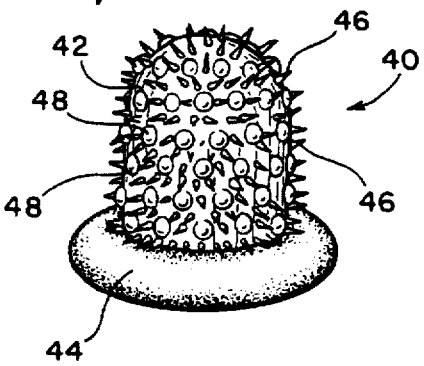
FIG. 6 is a front perspective view of another alternative embodiment of the exterior surface of the finger brush of the present invention where the finger brush includes a combination of bristles and bumps with an elongated sheath shown in a rolled-up configuration.

As shown in the alternative embodiment in FIG. 6, the finger mounted brush 40 incorporates the principles of the present invention as set forth with respect to the embodiments shown in FIGS. 2 through 5. In FIG. 6, the tip portion 42 extending from the sheath portion 44, shown in the rolled-up configuration, includes a plurality of bristles 46, as well as bumps or dimples 48. The combination of bristles and bumps provides a simultaneous cleaning and massaging effect.

The finger mounted brushes 10, 32 and 40 as shown in FIGS. 2, 5 and 6, respectively, may be used as illustrated in FIG. 1. In FIG. 1, an individual 50 mounts the brush 52 incorporating the principles of the present invention on a finger 54 in a rolled-up sheath portion configuration or un-rolled sheath portion configuration, depending upon the desired use of the individual 50. In the exemplary embodiment shown in FIG. 1, the finger mounted brush has the sheath portion unrolled and is used as a toothbrush and/or gum massager to facilitate cleaning the teeth and gums, and possibly massaging of the gums. In this embodiment, an adult is shown using the finger mounted brush incorporating the principles of the present invention.

Figure 7:
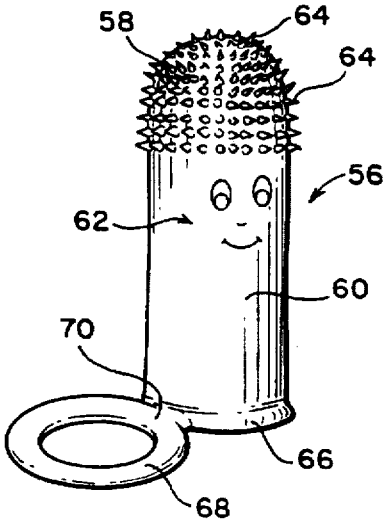
FIG. 7 illustrates an alternative embodiment of the present invention, particularly adapted for use with children as shown by the animated face included on the elongated sheath of the finger brush and the safety ring connected to the base of the sheath through which a second finger of a child would extend to ensure the anchoring of the finger brush on two of the child's fingers.

However, the present invention as shown in FIG. 1 is inapplicable for use by children. An embodiment directed to children is shown in FIG. 7. Finger mounted brush 56 is shown having a tip portion 58 and a sheath portion 60 which is normally in an un-rolled configuration. In a region of the sheath portion 60 adjacent to the tip portion 58 is included an animated face or illustration 62 designed to appeal to a child. In the example shown, the face 62 is designed to make the use of the finger mounted brush 56 appealing to small children.

In this embodiment, the tip portion 58 includes bristles 64 of a suitable rigidity for use by children. In addition, attached to base portion 66, is an annular safety ring 68 attached at an outer side edge portion 70 to the base portion 66 of the sheath portion 60. The internal diameter of ring 68 is dimensioned to fit around the middle finger of a child. The ring 68 is made of a flexible material so as to accommodate different widths of fingers for different children.

In use, the sheath portion 60 will be placed over the index finger of a child and the ring 68 will be placed over the middle finger of a child. The finger mounted brush 56 will thereby be securely anchored to two fingers of the child to prevent accidental dislodgement and potential choking of the child by the finger mounted brush 56. It is understood as being within the scope of the present invention that the face 62 would be of any configuration suitable for appealing to children.

Figure 8:
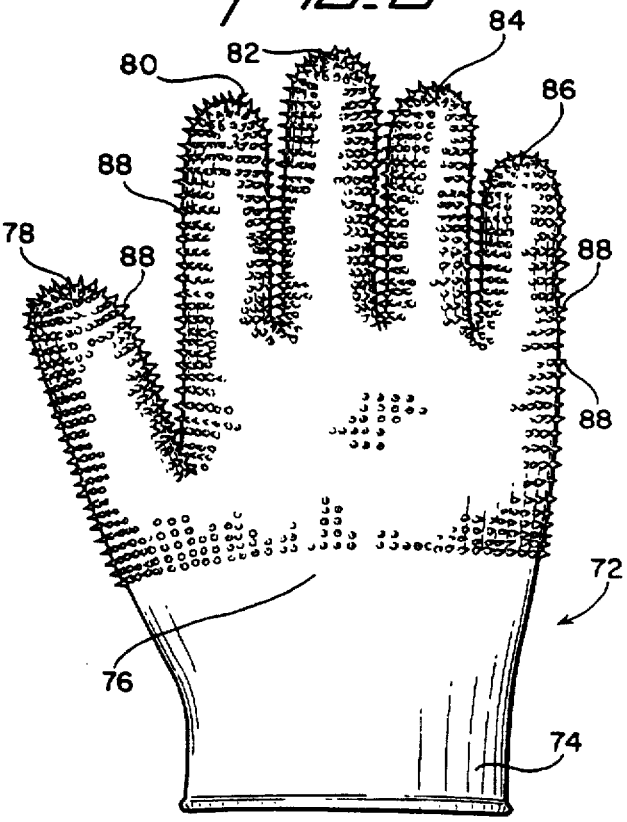
FIG. 8 is a front view of a glove brush incorporating the principles of the present invention, including bristles on five finger portions of the glove as well as a portion on the palm of the glove for use in a brushing or cleaning operation.

In FIG. 8, a hand mounted glove 72 incorporating the principles of the present invention is shown which includes a wrist portion 74, a palm portion 76, and finger portions 78, 80, 82, 84, 86. Located on the finger portions 72, 80, 82, 84 and 86, and a portion of the palm portion 76 are a plurality of bristles 88. It is understood that the bristles could have a configuration as shown in FIG. 2 through 4, bumps or dimples as shown in FIG. 5 or a combination thereof as shown in FIG. 6. Alternatively, the bristles 88 can be in the form of bristles of any known toothbrush.

The glove 72 may be used for removing or applying cosmetics, facial/body cleaning, denture cleaning, jewelry cleaning, household cleaning, polishing or shinning of surfaces, or medical uses, as a list of just some of the examples of the use of the glove 72. In addition, the glove 72 can be used in appropriately sized children models to avoid the necessity for a safety ring as in the FIG. 7 embodiment.

The glove 72 as well as the finger mounted brushes shown in the other figures can be sterilized when used in an environment where sterilization would be required. In addition, both the finger and hand mounted brushes are made of an elastic, plastic material. The thickness of the bristles and/or bumps would be based upon the desired use and degree of strength required to perform a particular function.

The foregoing is considered as illustrative only of the principles of the invention. Further, numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A brush device comprising:

a finger cover including a tip portion and a sheath portion, at least said tip portion including a plurality of projections located on an exterior surface of said finger cover, said plurality of projections being a combination of bristles and bumps, and an interior surface of said finger cover including a roughened texture for preventing sliding of said finger cover when in use on the finger of an individual.

2. A finger mounted brush device comprising:

a tip portion, a sheath portion rollable towards and away from said tip portion, a plurality of projections extending from an exterior surface of said tip portion, said plurality of projections being a combination of bristles and bumps, and an interior surface of at least said sheath portion including a non-slip lining to secure said sheath portion on finger of a person.

3. A finger mounted brush device as claimed in claim 2, wherein said plurality of projections are covered with a layer of dehydrated tooth paste.

* * * * *